US005785261A

United States Patent [19]

Lanner

[11] Patent Number: 5,785,261

[45] Date of Patent: Jul. 28, 1998

[54] DEVICE FOR REDUCING THE SIZE OF STEEL OR METAL CHIPS

[76] Inventor: Klaus Lanner, Mühlepfad 39a, D-77971 Kippenheim, Germany

[21] Appl. No.: 605,075

[22] PCT Filed: Sep. 13, 1994

[86] PCT No.: PCT/DE94/01052

§ 371 Date: Apr. 25, 1996

§ 102(e) Date: Apr. 25, 1996

[87] PCT Pub. No.: WO95/07757

PCT Pub. Date: Mar. 23, 1995

[30] Foreign Application Priority Data

Sep. 13, 1993 [DE] Germany ..... 43 30 882.1

[51] Int. Cl.[6] ..... B02C 25/00

[52] U.S. Cl. ..... 241/36; 241/82; 241/257.1; 241/261.1

[58] Field of Search ..... 241/46.06, 46.013, 241/46.014, 46.015, 46.016, 46.017, 257.1, 258, 259, 261.1, 82, 81, 36

[56] References Cited

U.S. PATENT DOCUMENTS

| | | | |
|---|---|---|---|
| 1,941,770 | 1/1934 | Welsford et al. | 241/257.1 X |
| 4,988,045 | 1/1991 | Griesedieck et al. . | |
| 4,998,045 | 3/1991 | Ruby . | |

FOREIGN PATENT DOCUMENTS

| | | | |
|---|---|---|---|
| 0 146 820 | 3/1987 | European Pat. Off. . | |
| 0418856 | 3/1991 | European Pat. Off. . | |
| 0402545 | 9/1993 | European Pat. Off. . | |
| 2340772 | 9/1977 | France . | |
| 598097 | 5/1934 | Germany . | |
| 1020222 | 11/1957 | Germany . | |
| 1115094 | 10/1961 | Germany . | |
| 290283 | 5/1971 | Germany . | |
| 2302859 | 7/1974 | Germany . | |
| 25 47 980 | 4/1977 | Germany . | |
| 3313928 | 10/1986 | Germany . | |
| 3621400 | 1/1988 | Germany . | |
| 8901794.3 | 7/1989 | Germany . | |
| 3932152A1 | 4/1991 | Germany . | |
| 4120456 | 12/1992 | Germany . | |
| 9209945.9 | 12/1992 | Germany . | |
| 4219090 | 12/1993 | Germany | 241/257.1 |
| 4330882 | 3/1995 | Germany . | |
| 531542 | 12/1976 | U.S.S.R. . | |
| 1304873 | 4/1987 | U.S.S.R. . | |
| 238350 | 9/1925 | United Kingdom . | |
| 884242 | 12/1961 | United Kingdom . | |

*Primary Examiner*—Mark Rosenbaum
*Attorney, Agent, or Firm*—Jones, Tullar & Cooper, P.C.

[57] ABSTRACT

A device for reducing steel or metal chips from material removing machining which has a tapered milling hopper connected with a feed hopper and a cutter head shaft having a rotating cutter head. The milling hopper has tearing units mounted at varying heights around its circumference, a milling mechanism arranged beneath the milling hopper, and an outlet channel in the lower region of the milling hopper but above the opening of a chip discharge sheet which can be opened and closed by means of a powered channel slide. In the open position of the powered channel the powered channel provides access to a recess in the discharge channel which is connected a coarse material ejection sheet running obliquely outwards. The milling mechanism connects of at least two superimposed annular milling discs which can be rotating shearing head with shearing blades about its circumference and spaced shearing grooves.

16 Claims, 3 Drawing Sheets

FIG. 4
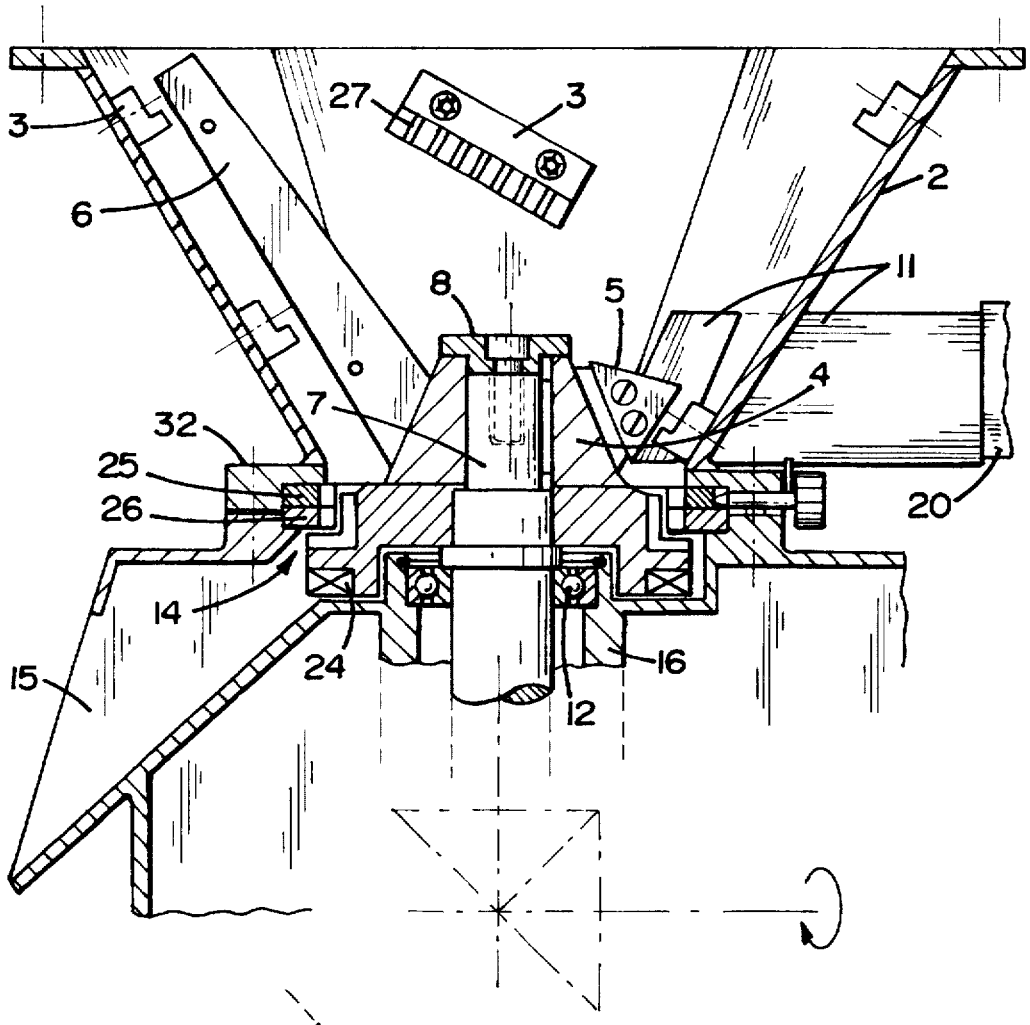
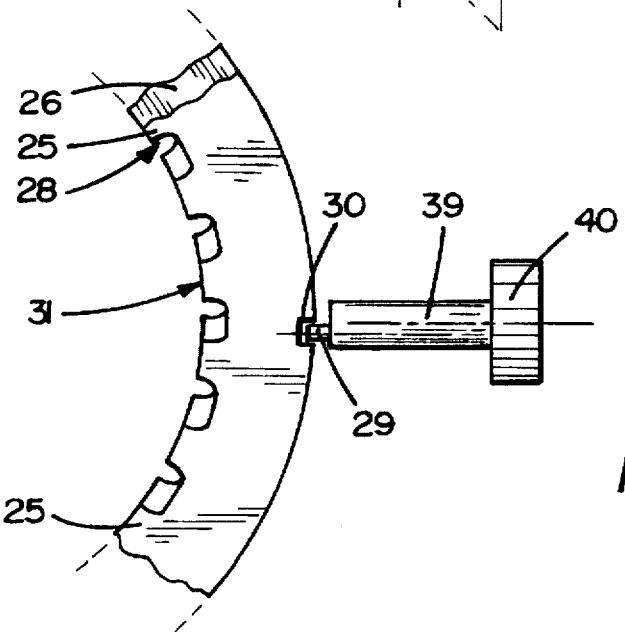
FIG. 5

DEVICE FOR REDUCING THE SIZE OF STEEL OR METAL CHIPS

BACKGROUND OF THE INVENTION

1. Field of the Invention

The present invention relates to a device for reducing the size of steel or metal chips generated by metal-cutting operations, the device having a receiving hopper and connected thereto a tapered milling hopper with tearing units arranged around its circumference, and with a tearing blade and triangular blades mounted on a rotating cutter head which pass by the tearing edges of the tearing units, and a milling unit under the milling hopper.

The long chips generated during metal-cutting operations become intertwined to form large tangles or clumps. The tangles or clumps are fed to the device to be reduced in size and for the cutting oil to be removed by centrifugation.

2. Prior Art

Known devices such as those described in DE G 89 01 794.3 or DE 42 19 080, as well as in U.S. Pat. No. 4,988,045 and EP-A-418,856, do not fully meet this requirement. They still require too long to process the chips and total reduction of all the clumps of chips is often not achieved. After coarse reduction of the chips is carried out, the material is fed to a milling unit having a milling disc equipped with milling grooves. Better size reduction of the clumps of chips is achieved in this way and the processing time is also shortened. There is less risk of clogging occurring, but it is not entirely eliminated.

There is another problem which is not solved, by some of the known devices, namely the problem caused by the occurrence of large, solid pieces of tramp metal in the flow of chips; such lumps of tramp metal are often not caught even by separating devices positioned in the area of the metal-cutting machines. A device for ejecting such pieces of material is described in the above-mentioned U.S. Pat. No. 4,988,045. In that device, an opening in the wall of the milling hopper can be opened and closed by means of a powered channel slide to provide an opening through which large pieces of tramp metal can be ejected.

Given these circumstances, the underlying purpose of the present invention is to prevent damage to the known device by providing an automatically functioning, operationally safe device for ejecting tramp metal, while retaining the already achieved advantages of preventing the flow of material within the device from being disrupted by clogging.

In a device of the type referred to herein, these advantages are obtained by:

a) an ejection channel is arranged in the lower section of the milling hopper, but above the mouth of the chip discharge chute. This ejection channel is openable or closable by means of a powered slide, and when the ejection channel is in the open position the slide exposes a downward-oriented outlet provided in the channel, to which is attached a tramp metal ejection chute leading outwardly at an angle, b) a milling unit comprising at least two annular shaped counter-rotatable milling discs arranged one on top of the other, whose annular inner surfaces surround the rotating shearing head which has shearing blades arranged around its circumference, with the inside surfaces equipped with shearing grooves arranged at a certain distance from each other.

If there is a large piece of tramp metal mixed in with the chips which, in the first processing stage, are to be reduced in size and broken up between the tearing units with their tearing edges, the tearing blade and the triangular blades, then this piece of metal will be located in the lower part of the milling hopper where it will be rotated by the cutting head together with the chip material. This causes clumping and compaction and the rotation of the cutting head is slowed or in some cases even totally jammed. This can be prevented by opening up an ejection channel in the lower section of the milling hopper by retracting a slide which normally closes off the channel during normal operation. The large item of material which has been recognized as a foreign body is pushed out of the milling hopper through this channel by the rotation of the cutter head. When the ejection opening is exposed by retracting the channel slide, it opens into a downward—oriented outlet through which the large piece of material is guided downwards by the ejection chute. Further advantages are derived from the annular-shaped milling discs, at least two of which are arranged one on top of the other and such that they can be rotated against each other. This configuration prevents a foreign body, for example a large or even a small piece of tramp metal, from proceeding further along the chip processing pathway because it is forced to remain above the uppermost milling disc and cannot get into the milling unit.

EP-A-0 418 856 describes a reducing device in which two exchangeable so-called stationary cutters are arranged one on top of the other and are provided with so-called classifying recesses of various dimensions, being intended chiefly for paper, wood and plastic. This arrangement of comminuting tools does not contain operationally counter-rotatable milling discs with shearing grooves, so as to permit the profile of the shearing grooves to be adjusted and matched to the required size reduction of metal or steel chips. The groove profile can be so adjusted that even small foreign bodies do not become jammed but are removed from the milling hopper—in the manner described—through the ejection opening.

In addition, through the design of the milling discs, which are fitted with shearing grooves and can be rotated against each other, the chips are reduced in size to a selectable, precisely definable extent so that the risk of clogging and/or damage is very largely eliminated by these two fundamental features or measures.

Further features of the present invention include the fact that the channel slide is moved longitudinally in the ejection channel and can be moved into the open or closed positions by means of a signal-controlled reversible drive. Another particularly important feature is that a control device acting in conjunction with the motor-driven cutter head is provided with a first signal transmitter to control the channel slide and also with a second signal transmitter to control the slow reverse motion of the cutter head drive.

Through this design according to the present invention, the opening and closing motion of the channel slide is functionally interlinked with a very slow reversing motion of the cutter head. This ensures that the large foreign body is pushed out into the ejection channel, which is arranged in an essentially horizontal plane, but may also be angled downwards. The closing cycle of the ejection channel can be repeated at staggered intervals if the foreign body is not ejected during the first cycle or if a second foreign body is present.

This design may be varied by arranging in the ejection channel an optical, electromagnetic, electro-inductive, or similar sensor having a third signal transmitter and acting in conjunction with a control device and its signal transmitters controlling the channel slide, and with the signal transmitter controlling the reversing drive of the cutter head, so that foreign bodies leaving the milling hopper via the ejection channel can trigger the closing of the ejection channel and cause the cutter head to rotate once more in its normal direction.

Among other features of the present invention, the shearing grooves are 6 mm wide and 5 mm deep and furthermore one of the milling discs is mounted in an annular-shaped recess in a flange section of the housing in such a way as to be rotatable against the other non-rotatingly mounted milling disc. This counter rotation of one disc in relation to the other is made possible by the fact that the position of the rotatable milling disc with reference to the fixed milling disc can be adjusted by means of a rotatable eccentric pin which engages in a recess on the outer circumference of the rotatable milling disc. These features permit the position of the rotatable milling disc to be varied in relation to the fixed milling disc by rotating a eccentric pin so that the shearing grooves, which are located one on top of the other, are offset in relation to each other. The resulting overlap allows the width of the shearing grooves to be set larger or smaller so that only chips of a desired maximum size pass from the milling hopper into the milling unit below.

In a further configuration of the present invention, the shearing blades each consist of two leg sections enclosing an angle, and the leg sections are arranged adjacent to but at a small distance from the inside circumference and the underside of the milling discs, and in fact the shearing blades run past the inner surfaces of the milling discs at a spacing of 0.1 to 0.5 mm. The chips are reduced to the desired size, depending on this gap that is adjusted between the two associated cutting devices.

According to another feature of the present invention, the device is designed in such a way that the legs of the shearing blades, which run at an angle to the cutter head shaft, rest on a circular collar fitted to the shearing head, and projections which serve as chip ejectors are fitted circumferentially to the (lower) annular surface of the collar, i.e. on the side opposite the legs of the shearing blades. The chips are transported by the projections in the lower annular recess of the housing in the same direction of rotation as the cutter head, until they reach a chip removal chute attached to the circumference of the housing. This measure also helps prevent the machine from becoming clogged with chips.

Better size reduction and greater reliability against clogging can also be achieved by ensuring that the tearing edges of the tearing units arranged at angles of 65 to 45 degrees are shaped so as to be adapted to the contour of the tearing edges of the tearing blade and of the triangular blades, i.e. so that the gap between the interacting tearing edges does not exceed 0.1 to 0.5 mm, and furthermore by using hardened steel as the material for the tearing blades, triangular blades and tearing surfaces.

The tearing edges of the tearing units are interrupted by closely spaced grooves of curved cross section; this is another important feature ensuring optimum size reduction and the onward transportation of the chips.

According to another embodiment, it is possible to arrange the lower triangular blades so that their tearing edges run at an angle of inclination of between 15 and 35 degrees to the vertical plane passing through the axis of rotation of the cutter head shaft. This angle of inclination between the sharp tearing edges, combined with the action of the tearing blades as they pass by at a narrow spacing from the tearing units, generates a tugging-cutting effect which results in more successful separation and size reduction of the clumps of chips, thereby avoiding simply crushing the clumps, which can lead to clogging of the machine.

BRIEF DESCRIPTION OF THE DRAWINGS

FIG. 4: A vertical section as shown in FIG. 1, but on a larger scale.

FIG. 5: is a partial top view of the rotatable milling disc with the eccentric pin in engagement.

DETAILED DESCRIPTION OF THE PREFERRED EMBODIMENTS

Figure 1:
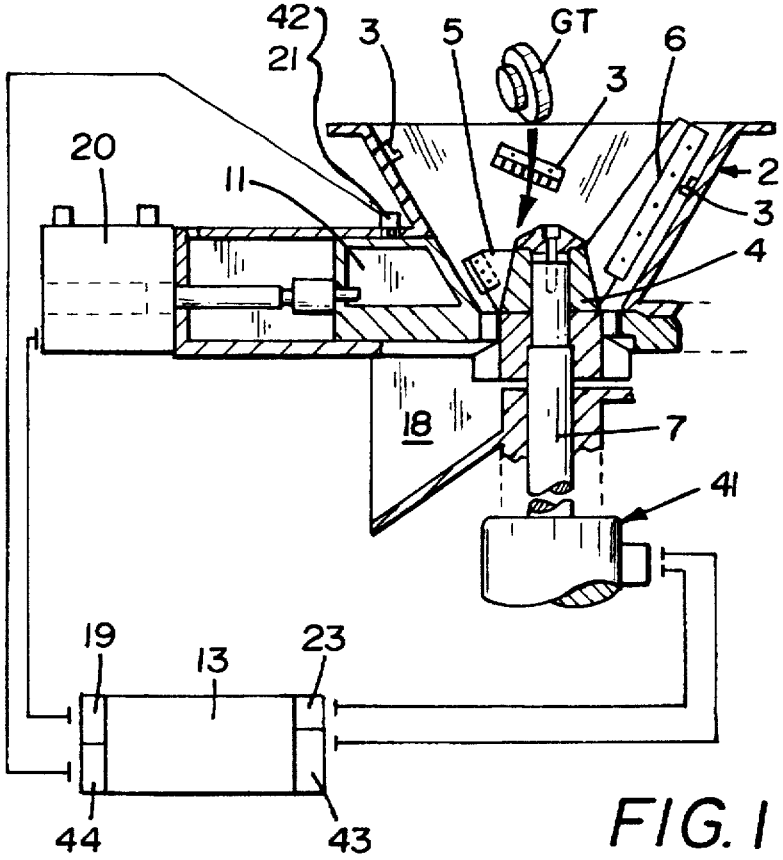
FIG. 1: is a vertical section through a reducing device according to the present invention showing the ejection channel in the closed position.
Figure 2:
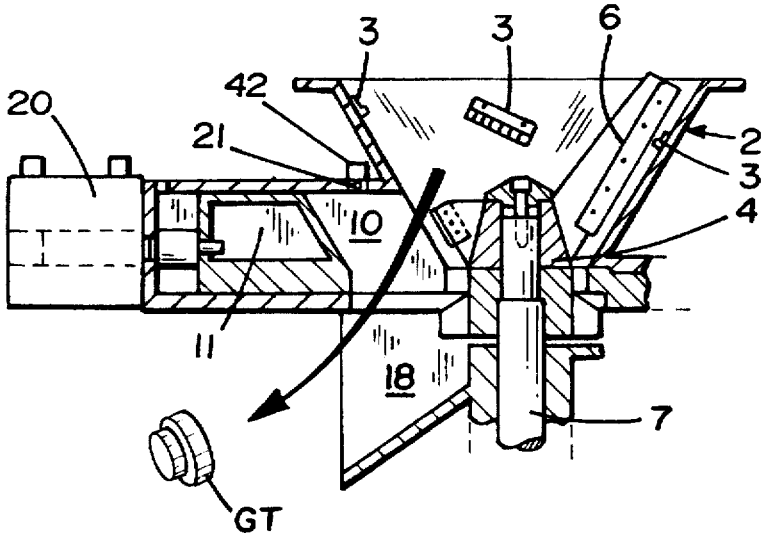
FIG. 2: is the same vertical section as in FIG. 1, showing however the ejection channel in the opened position.

FIGS. 1 and 2 show in simplified form the device having a milling hopper 2 with tearing units arranged at various heights and a cutter head shaft 7 with a cutter head 4 which is fitted with at least one tearing blade 6 and at least one triangular blade 5. In addition, the cutter head drive with the control unit 41 can be seen in the lower part of FIG. 1.

An ejection channel 10 opens into the milling hopper 2 and is equipped with a channel slide 11, which in FIG. 1 is shown in its forward position, thereby closing off the ejection channel 10, and in FIG. 2 in its retracted position in which the ejection channel 10 is held open.

Reference number 13 denotes a control device which regulates and coordinates the movements of the channel slide 10 and the cutter head shaft 7. When the speed of the cutter head shaft 7 drops (or when the shaft is stationary) because of jamming caused by a large piece of tramp metal (denoted by GT in the Figure), the control of the cutter head drive 41 sends a signal to the control device 13, thus triggering two functions. A first signal transmitter 19 activates the control of the channel slide, causing it to open, i.e. it moves back to the position shown in FIG. 2. At the same time, the second signal transmitter 23 adjusts the control 41 of the cutter head drive in such a way that the cutter head 4 rotates slowly in reverse until it has pushed the fragment of tramp metal (GT) into the ejection channel, from where it falls, via an ejection chute 18, into a container which is not depicted here.

A sensor 21, with a third signal transmitter 42, switches the signal receiver 44 so that via the fourth signal transmitter 43 it causes the cutter head drive 41 to revert to normal operation.

This design configuration ensures that foreign bodies, in particular large pieces of tramp metal, are quickly removed from the milling hopper 2 before the cutting and tearing units are damaged or destroyed.

Figure 3:
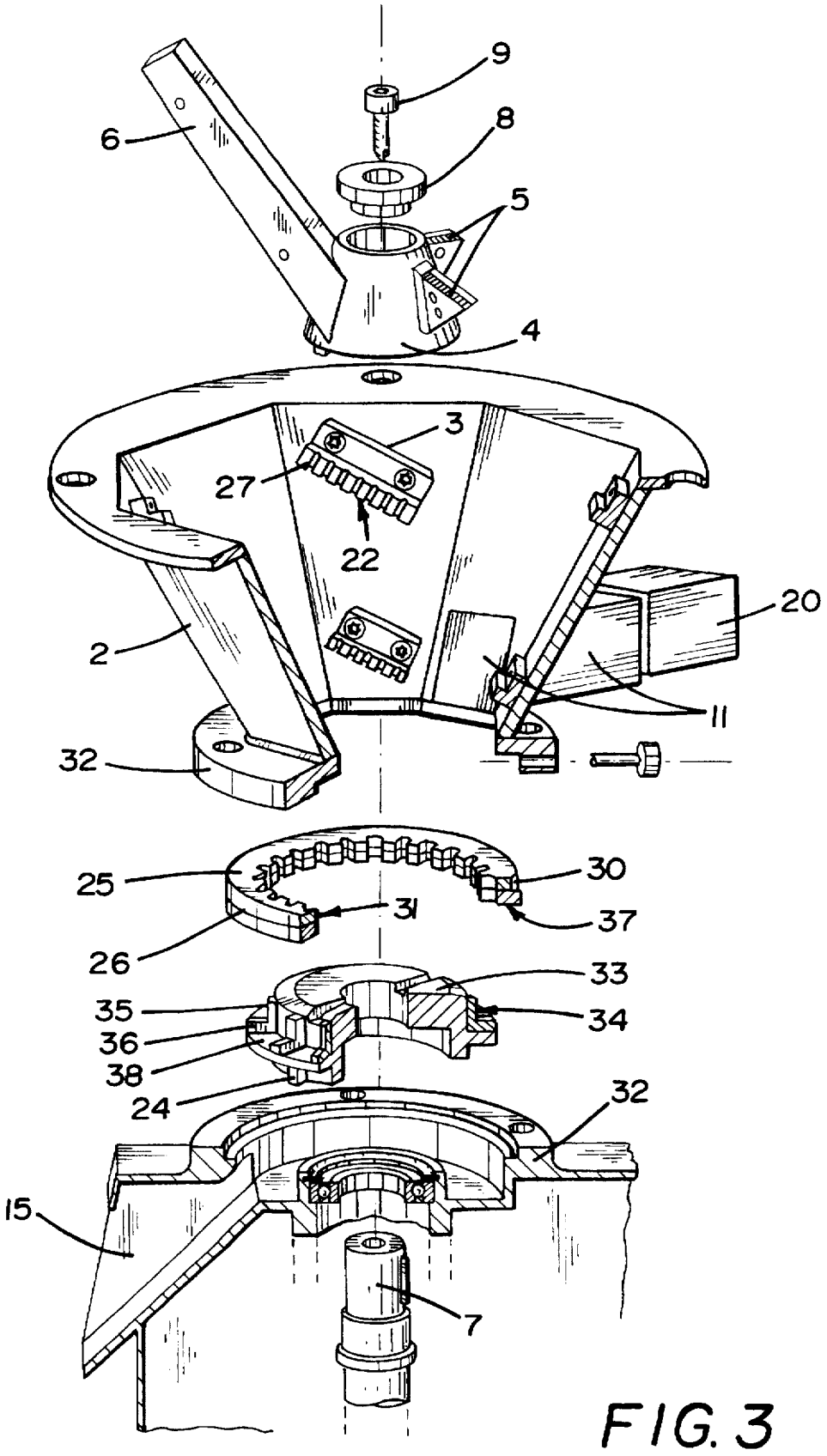
FIG. 3: is a exploded view of the individual parts of the device, some of them shown in cross section.

The exploded view in FIG. 3 and also FIGS. 4 and 5 show further details of the device.

FIG. 3 shows the milling hopper 2 which has the shape of a polygonal cone; the width MT of the milling hopper 2 at the point of transition to a receiving hopper (not shown) which is situated above the milling hopper 2, is preferably between 280 and 500 mm. In the example, a dimension of 400 mm was chosen to match the width of the receiving hopper and thus achieve a smooth transition between the two for the transportation of the chips.

The inside of milling hopper 2 has mounted thereto tearing units 3 located at varying heights around its circumference.

Within the milling hopper 2 is located the rotating cutter head shaft 7 with an associated cutter head 4. Around the circumference of the cutter head 4 are arranged a tearing blade 6 and two triangular blades 5, which act in conjunction with the tearing edges 22 of the tearing units 3 so that the reduction of the chips takes place between the tearing edges as they move by each other. The gap between the interacting tearing edges is set at between 0.1 and 0.5 mm.

The tearing units 3 with their tearing edges 22 are arranged at an angle of 65 to 45 degrees to the vertical plane formed by the axis of rotation of the cutter head shaft 7. The tearing edges 22 of the tearing units 3 are provided with closely spaced grooves (spacing "a") 27 having a width and depth of between 2 and 4 mm. The tearing blade 6, triangular blades 5 and the tearing surfaces are made of hardened steel and their edges are precision-machined. The described type and arrangement of the individual components, combined with the grooves 27 on the tearing units 3, achieve optimal break-up and size reduction of the clumps of chips before they enter the milling unit, thereby at the same time avoiding the risk of the device becoming clogged.

The cutter head 4 is attached to the rotating cutter head shaft 7, which is mounted by means of bearings 12 in bearing block 16. In its upper region, the cutter head 4 possesses a removable cover 8 with an associated bolt element 9. The cover 8 is secured by tightening the bolt in the direction of the vertical axis of the cutter head shaft 7.

In the upper region of the milling hopper 2 the clumps of chips are at first torn apart and broken up into smaller portions. In the lower region of the milling hopper these portions are further broken up and torn apart by the triangular blades 5. The fine reduction of the material takes place in the adjoining region between the milling discs 25, 26 and the shearing blades 34 of the shearing head 33. This region constitutes the actual milling unit.

Depending on the desired chip size, the distance between—on the one hand—the annular inner surfaces 31 and the underside 37 of the milling discs 25, 26 and—on the other hand—the surfaces 35, 36 of the legs of the shearing blades 34, which are in contact with these surfaces, can be adjusted to between 0.1 and 0.5 mm.

According to FIG. 5, there is a recess 30 on the outer circumference of the rotatable milling disc 25 into which an eccentric pin 29 engages. The milling disc 25 is displaced by rotating the knurled knob 40 on the eccentric shaft 39 which is attached to the eccentric pin 29. After the milling disc 25 has been rotated, the width of the shearing groove 28 is 4 mm.

Depending on the desired chip size, the distance between—on the one hand—the annular inner surfaces 31 and the underside 37 of the milling discs 25, 26 and—on the other hand—the surfaces of the legs of the shearing blades 34, which are in contact with these surfaces, is set in the example at 0.3 mm. In accordance with the foregoing explanations, only chips of a size suitable for passing through the gap will move from the milling hopper 2 into the milling zone.

It can be seen from FIGS. 3 and 4 that the rotatable milling disc 25 is rotatably located on the non-rotating milling disc 26 in the upper annular recess of the flange section of the housing 32.

Furthermore, it can be seen from FIGS. 3 and 4 that the tearing edges of the triangular blades 5 arranged on the lower part of the cutter head 4 are inclined at an angle of between 15 and 35 degrees to the vertical plane running through the axis of rotation of the cutter head shaft 7. This inclination of the tearing edges continues the break-up of the clumps of chips into smaller portions which had been initiated in the upper section of the milling hopper 2; mere crushing of the clumps of chips, and the associated risk of clogging, is thus avoided.

According to FIGS. 3 and 4, the legs 35, 36 of the shearing blades 34, which run at an angle to the cutter head shaft 7, are positioned on the circular collar of the shearing head 33. Projections 24, which serve as chip ejectors, are distributed circumferentially on the lower annular surface, i.e. the side opposite the legs 25, 36 of the shearing blades. These projections run in the lower recess of the housing 32 and, in keeping with the shape of this recess, they are preferably rectangular in shape. The projections 24 transport the chips in the lower recess of the housing 32 in the same direction of rotation as the shearing head 33 to the chip discharge chute 15 located at the periphery of the recess, and the chips slide down the inclined chute into collection facilities waiting to receive them.

I claim:

1. A device for reducing the size of steel or metal chips produced by metal-cutting operations, comprising:

a cutter head shaft defining an axis of rotation;

a cutter head mounted for rotation on said cutter head shaft;

a tapered milling hopper surrounding said cutter head and said cutter head shaft and attached to a receiving hopper;

a plurality of tearing units arranged at various heights around the circumference of said tapered milling hopper, each said tearing unit defining a tearing edge which is inclined at an angle relative to said axis of said cutter head shaft;

a tearing blade and a plurality of triangular blades mounted to said cutter head for movement past said plurality of tearing units;

a chip removal chute arranged below said tapered milling hopper, said chip removal chute defining a mouth;

a milling unit arranged below said tapered milling hopper and adjoining said chip removal chute;

an ejection opening formed in the wall of said tapered milling hopper for large pieces of tramp metal;

an ejection channel provided above and opposite to said mouth of said chip removal chute, said ejection channel defining a downward-opening outlet;

a shearing head defining a circumference on which a plurality of shearing blades are situated; and a powered channel slide for opening and closing said downward-opening oulet and providing, in an open position, access to said mouth of said chip removal chute through said ejection opening and said downward-opening outlet, wherein said milling unit includes at least two annular counter-rotatable milling discs arranged one on top of the other, said milling discs defining annular inner surfaces that surround said rotating shearing head, said annular inner surfaces being provided with shearing grooves spaced a certain distance apart from each other.

2. The device as defined in claim 1, further comprising:

a signal-controlled reversible drive for moving said powered channel slide between an open position and a closed position, wherein said powered channel slide is displaceable longitudinally in said ejection channel.

3. The device as defined in claim 2, further comprising:

a cutter head drive; and a control device having a first signal transmitter for controlling said powered channel slide and a second signal transmitter for controlling a slow reverse motion of said cutter head drive.

4. The device as defined in claim 3, further comprising:

at least one sensor of an optical, electromagnetic, or electro-inductive type is provided in said ejection channel, wherein said control device has a third transmitter which together with said sensor controls movement of said powered channel slide and also the reverse motion of said cutter head drive.

5. The device as defined in claim 1, wherein said first signal transmitter causes said powered channel slide to assume its open position when the speed of said cutter head achieves one of a reducing or stopped speed condition and said second signal transmitter causes said drive of said cutter head to proceed into a slow reverse motion, and wherein said sensor activate said first and second signal transmitters causing said powered channel slide to assume its closed position and said said cutter head to resume its normal speed when a large item of tramp metal is detected.

6. The device as defined in claim 1, wherein said ejection channel is rectangular in cross section and oriented essentially horizontally relative to said tapered milling hopper.

7. The device as defined in claim 1, wherein one of said milling discs is stationary and the other milling disc rotates relative to said stationary milling disc.

8. The device as defined in claim 1, wherein said shearing blades of said shearing head each comprise two sections which enclose an angle such that one of said two sections is spaced from and adjacent the inner circumference of one of said milling discs and the other of said two sections is spaced from and adjacent the lower side of the other of said milling discs.

9. The device as defined in claim 8, wherein the spacing of said one of said two sections from the inner circumference of one of said milling discs is between 0.1 to 0.5 mm.

10. The device as defined in claim 1, wherein said shearing head includes a circular collar on which said shearing blades are positioned, said circular collar having a plurality of chip ejecting projectors positioned circumferentially thereon on a face opposite to that on which said shearing blades are positioned.

11. The device as defined in claim 1, wherein the tearing edges of said plurality of tearing units are arranged at an angle of 65 to 45 degrees, and are shaped so as to be adapted to the contour of the tearing edges of said tearing blade and of said triangular blades, such that the gap between the interacting tearing edges does not exceed 0.1 to 0.5 mm.

12. The device as defined in claim 1, wherein said tearing blade, said triangular blade and said tearing surfaces are made of hardened steel with precision-machined tearing edges.

13. The device as defined in claim 11, wherein the tearing edges of said plurality of tearing units are interrupted by grooves positioned at short distances from each other.

14. The device as defined in claim 1, wherein said plurality of triangular blades include tearing edges and said plurality of triangular blades are arranged with their tearing edges inclined at an angle to the vertical plane running through said axis of rotation.

15. The device as defined in claim 14, wherein the angle of inclination is between 15 and 35 degrees.

16. The device as defined in claim 1, wherein said shearing grooves are 6 mm wide and 5 mm deep.

* * * * *

UNITED STATES PATENT AND TRADEMARK OFFICE

CERTIFICATE OF CORRECTION

PATENT NO. : 5,785,261
DATED : July 28, 1998
INVENTOR(S) : Klaus Lanner

It is certified that error appears in the above-identified patent and that said Letters Patent is hereby corrected as shown below:

Column 6,
Line 49, change “oulet” to -- outlet --.

Column 7,
Line 10, change “1” to -- 4 --; and
Line 18, delete “said” (second occurrence)

Column 8,
Line 4, change “1” to -- 8 --.
Line 20, change “interrrupted” to -- interrupted --.

Signed and Sealed this

Eighteenth Day of June, 2002

*Attest:*

*Attesting Officer*

JAMES E. ROGAN
*Director of the United States Patent and Trademark Office*